US010711526B2

(12) United States Patent
Bomidi

(10) Patent No.: US 10,711,526 B2
(45) Date of Patent: Jul. 14, 2020

(54) METHODS FOR FORMING OR SERVICING A WELLBORE, AND METHODS OF COATING SURFACES OF TOOLS

(71) Applicant: Baker Hughes, a GE company, LLC, Houston, TX (US)

(72) Inventor: John Abhishek Raj Bomidi, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 132 days.

(21) Appl. No.: 15/422,097

(22) Filed: Feb. 1, 2017

(65) Prior Publication Data

US 2018/0216408 A1 Aug. 2, 2018

(51) Int. Cl.

| | |
|---|---|
| ***E21B 10/24*** | (2006.01) |
| ***E21B 10/50*** | (2006.01) |
| ***C10M 177/00*** | (2006.01) |

(52) U.S. Cl.

CPC ..... *E21B 10/24* (2013.01); *C10M 177/00* (2013.01); *C10N 2210/01* (2013.01); *C10N 2230/08* (2013.01); *C10N 2240/06* (2013.01); *C10N 2250/08* (2013.01); *C10N 2250/10* (2013.01); *C10N 2270/00* (2013.01); *E21B 10/50* (2013.01)

(58) Field of Classification Search

CPC ..... E21B 10/24

See application file for complete search history.

(56) References Cited

U.S. PATENT DOCUMENTS

| | | | |
|---|---|---|---|
| 2,645,613 | A | 7/1953 | Adelson et al. |
| 3,309,313 | A | 3/1967 | Callahan |
| 3,530,068 | A | 9/1970 | Korshak et al. |
| 3,629,103 | A | 12/1971 | Korshak et al. |
| 4,186,244 | A | 1/1980 | Deffeyes et al. |
| 4,304,444 | A | 12/1981 | Persson |
| 4,381,824 | A | 5/1983 | Pastusek |
| 4,647,386 | A | 3/1987 | Jamison |

(Continued)

FOREIGN PATENT DOCUMENTS

| | | | | |
|---|---|---|---|---|
| GB | 879991 | A | 10/1961 | |
| WO | 2015172846 | A1 | 8/2014 | |
| WO | WO-2014147236 | A1 * | 9/2014 | ..... E21B 41/00 |

OTHER PUBLICATIONS

Skeates et al. "High-Pressure, High-Temperature Technologies" Oilfield Review. Autumn 2008. pp. 46-60 (Year: 2008).*

(Continued)

*Primary Examiner* — Robert E Fuller

*Assistant Examiner* — Theodore N Yao

(74) *Attorney, Agent, or Firm* — TraskBritt

(57) ABSTRACT

A method of utilizing a wellbore tool in a subterranean formation includes disposing a wellbore tool in a borehole. The wellbore tool has a first body and a second body. The first body is translated relative to the second body while exposing at least one surface of at least one of the first and second bodies to a lubricant comprising an organometallic compound, and a protective coating forms over the first body and/or the second body. The protective coating formed includes a metal originating from the organometallic compound. A tool for forming or servicing a wellbore includes a first body; a second body configured to translate relative to the second body; and a lubricant adjacent the first body and the second body.

15 Claims, 3 Drawing Sheets

(56) References Cited

U.S. PATENT DOCUMENTS

| | | | | |
|---|---|---|---|---|
| 5,866,518 | A | 2/1999 | Dellacorte et al. | |
| 6,942,825 | B2 | 9/2005 | Honda et al. | |
| 7,267,183 | B2 | 9/2007 | Denton et al. | |
| 7,312,185 | B2 | 12/2007 | Willey et al. | |
| 7,749,947 | B2 * | 7/2010 | Griffo | C10M 125/02 175/331 |
| 8,486,870 | B1 | 7/2013 | Malshe | |
| 2006/0289837 | A1 | 12/2006 | McNeilly et al. | |
| 2007/0051510 | A1 * | 3/2007 | Veneruso | E21B 43/128 166/244.1 |
| 2009/0229886 | A1 | 9/2009 | Koltermann | |
| 2014/0231145 | A1 | 8/2014 | Kverel et al. | |
| 2014/0231148 | A1 | 8/2014 | Kverel et al. | |
| 2016/0145531 | A1 | 5/2016 | Erdemir et al. | |
| 2016/0186083 | A1 | 6/2016 | White et al. | |
| 2016/0348444 | A1 * | 12/2016 | Olsen | E21B 10/00 |
| 2017/0217993 | A1 * | 8/2017 | Delferro | C07F 1/005 |

OTHER PUBLICATIONS

Michael Desanker et al., "Oil-Soluble Silver-Organic Molecule for in Situ Deposition of Lubricious Metallic Silver at High Temperatures," ACS Appl. Mater. Interfaces, 2016, 8 (21), pp. 13637-13645 (Year: 2016).*

Bondarev et al., A New Insight into Hard Low Friction MoCN—Ag Coatings Intended for Applications in Wide Temperature Range, Materials and Design, vol. 93, (Dec. 2015), pp. 63-72.

Canter, Neil, Tribocatalysis: A New Extreme Pressure Lubrication Approach, Tribology, & Lubrication Technology, Oct. 2016, pp. 10-11.

Cunningham, Greg, Argonne Discovery Yields Self-Healing Diamond-Like Carbon, https://www.anl.gov/articles/argonne-discovery-yields-self-healing-diamond-carbon, Aug. 5, 2016, 3 pages.

Desanker et al., Oil-Soluble Silver-Organic Molecule for in Situ Deposition of Lubricious Metallic Silver at High Temperatures, ACS Appl. Mater. Interfaces, 2016, 8 (21), pp. 13637-13645.

Erdemir et al., Carbon-Based Tribofilms From Lubricating Oils, Nature, vol. 536, (Aug. 4, 2016), pp. 67-71.

Zhang et al., Preparatation and Characterizations of Nickel-Based Composite Coating with Self-Lubricating Property at Elevated Temperatures, Surface & Coatings Technology, vol. 294, (2016), pp. 21-29.

Ortega et al., "Frictional Heating and Convective Cooling of Polycrystalline Diamond Drag Tools During Rock Cutting," (1982), available at https://www.osti.gov/servlets/purl/5244420 (also published by Society of Petroleum Engineers Journal, vol. 24, Issue 02 (Apr. 1984)).

* cited by examiner

METHODS FOR FORMING OR SERVICING A WELLBORE, AND METHODS OF COATING SURFACES OF TOOLS

FIELD

Embodiments of the present disclosure relate generally to methods and tools for forming or enlarging wellbores, as well as methods and tools for performing other operations within wellbores, by forming protective coatings on surfaces of tools during use.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit such as, for example, an earth-boring rotary drill bit. Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

A drill string may include a number of components in addition to a downhole motor and drill bit including, without limitation, drill pipe, drill collars, stabilizers, measuring while drilling (MWD) equipment, logging while drilling (LWD) equipment, downhole communication modules, and other components.

In addition to drill strings, other tool strings may be disposed in an existing well bore for, among other operations, completing, testing, stimulating, producing, and remediating hydrocarbon-bearing formations.

When drilling, completing, testing, stimulating, producing, or remediating a wellbore, surfaces of drill string and tool string components may be exposed to harsh conditions, and may become damaged. For example, protective coatings formed or applied over surfaces of tool components during manufacture and prior to disposition in a wellbore may become scratched, exposing metal underneath. Damage may occur on interior and/or exterior surfaces of such components. Such damage may lead to corrosion and premature failure of such components and to additional costs associated with removal and repair or replacement of damaged components.

BRIEF SUMMARY

A method of utilizing a wellbore tool in a subterranean formation includes disposing the wellbore tool in a borehole. The wellbore tool includes a first body and a second body. The method further includes translating the first body relative to the second body while exposing at least one surface of at least one of the first and second bodies to a lubricant comprising an organometallic compound, and forming a protective coating over a surface of at least one body selected from the group consisting of the first body and the second body. The protective coating formed includes a metal of the organometallic compound.

A method of coating a surface of a tool includes disposing the tool in a borehole, the tool having at least one uncoated surface. The method further includes contacting the at least one uncoated surface with a lubricant adjacent a body and forming a protective coating on the at least one uncoated surface. The lubricant includes an organometallic compound. The protective coating includes a metal of the organometallic compound.

A tool for forming or servicing a wellbore includes a first body; a second body configured to translate relative to the second body; and a lubricant adjacent the first body and the second body. The lubricant includes an organometallic compound.

DETAILED DESCRIPTION

Figure 1:
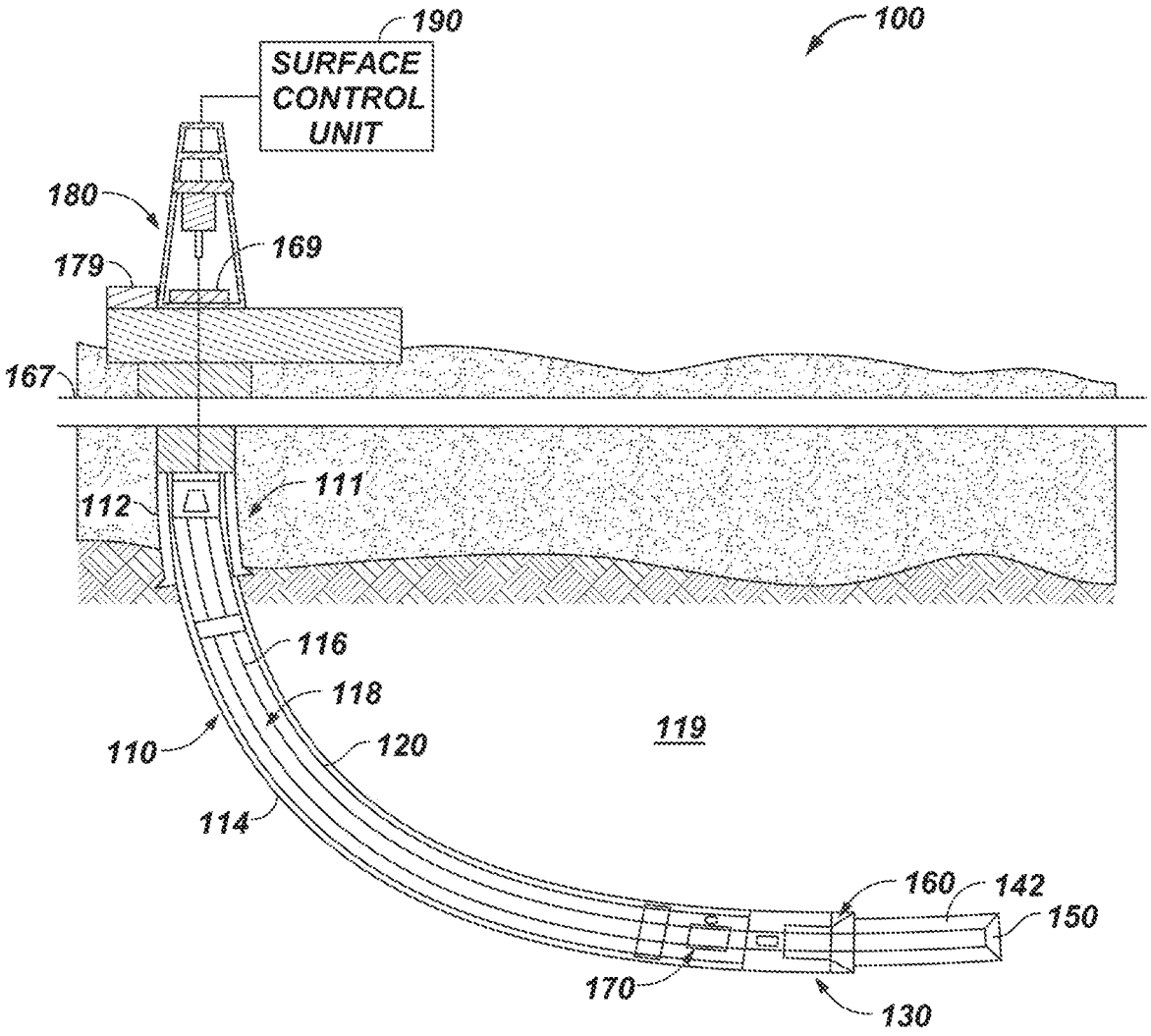
FIG. 1 is a simplified schematic diagram of an example of a drilling system in accordance with an embodiment of the disclosure.

The illustrations presented herein are not actual views of any particular tool or drill string, but are merely idealized representations that are employed to describe example embodiments of the present disclosure. Additionally, elements common between figures may retain the same numerical designation.

The following description provides specific details of embodiments of the present disclosure in order to provide a thorough description thereof. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all elements to form a complete structure or assembly. Only those process acts and structures necessary to understand the embodiments of the disclosure are described in detail below. Additional conventional acts and structures may be used. Also note, any drawings accompanying the application are for illustrative purposes only, and are thus not drawn to scale. Additionally, elements common between figures may retain the same numerical designation.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof.

As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures.

As used herein, the term "sustained," when referring to a duration of a temperature to which a wellbore tool or components thereof is exposed, means and includes a period of time lasting at least 0.1 seconds.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

In some embodiments, disclosed methods form protective coatings over surfaces of wellbore tools during tool use in a subterranean formation. For example, a wellbore tool may be disposed within a borehole. The wellbore tool may include a first body and a second body. The first body may translate relative to the second with a lubricant adjacent the first body and the second body. The lubricant may include an organometallic compound. A protective coating may be over the first body and/or the second body during at least part of the operation. The protective coating may be formed from the organometallic compound.

FIG. 1 is a schematic diagram of an example of a drilling system 100 utilizing the apparatus and methods disclosed herein. FIG. 1 shows a wellbore 110 that includes an upper section 111 with a casing 112 installed therein and a lower section 114 that is being drilled with a drill string 118. The drill string 118 includes a tubular member 116 that carries a drilling assembly 130 at its bottom end. The tubular member 116 may be formed by joining drill pipe sections or may be coiled tubing. A drill bit 150 (also referred to as the "pilot bit") is attached to the bottom end of the drilling assembly 130 for drilling a first, smaller diameter borehole 142 in the formation 119. A reamer bit 160 may be placed above or uphole of the drill bit 150 in the drill string to enlarge the borehole 142 to a second, larger diameter borehole 120. The terms wellbore and borehole are used herein as synonyms.

The drill string 118 extends to a rig 180 at the surface 167. The rig 180 shown is a land rig for ease of explanation. The apparatus and methods disclosed herein equally apply when an offshore rig is used for drilling underwater. A rotary table 169 or a top drive may rotate the drill string 118 and the drilling assembly 130, and thus the pilot bit 150 and reamer bit 160, to respectively drill boreholes 142 and 120. The rig 180 also includes conventional devices, such as mechanisms to add additional sections to the tubular member 116 as the wellbore 110 is drilled. A surface control unit 190, which may be a computer-based unit, is placed at the surface for receiving and processing downhole data transmitted by the drilling assembly 130 and for controlling the operations of the various devices and sensors 170 in the drilling assembly 130. A drilling fluid from a source 179 thereof is pumped under pressure through the tubular member 116 that discharges at the bottom of the pilot bit 150 and returns to the surface via the annular space (also referred to as the "annulus") between the drill string 118 and an inside wall of the wellbore 110.

During operation, when the drill string 118 is rotated, both the pilot bit 150 and the reamer bit 160 rotate. The pilot bit 150 drills the first, smaller diameter borehole 142, while simultaneously the reamer bit 160 enlarges the borehole 142 to a second, larger diameter borehole 120. The earth's subsurface may contain rock strata made up of different rock structures that can vary from soft formations to very hard formations.

Figure 2:
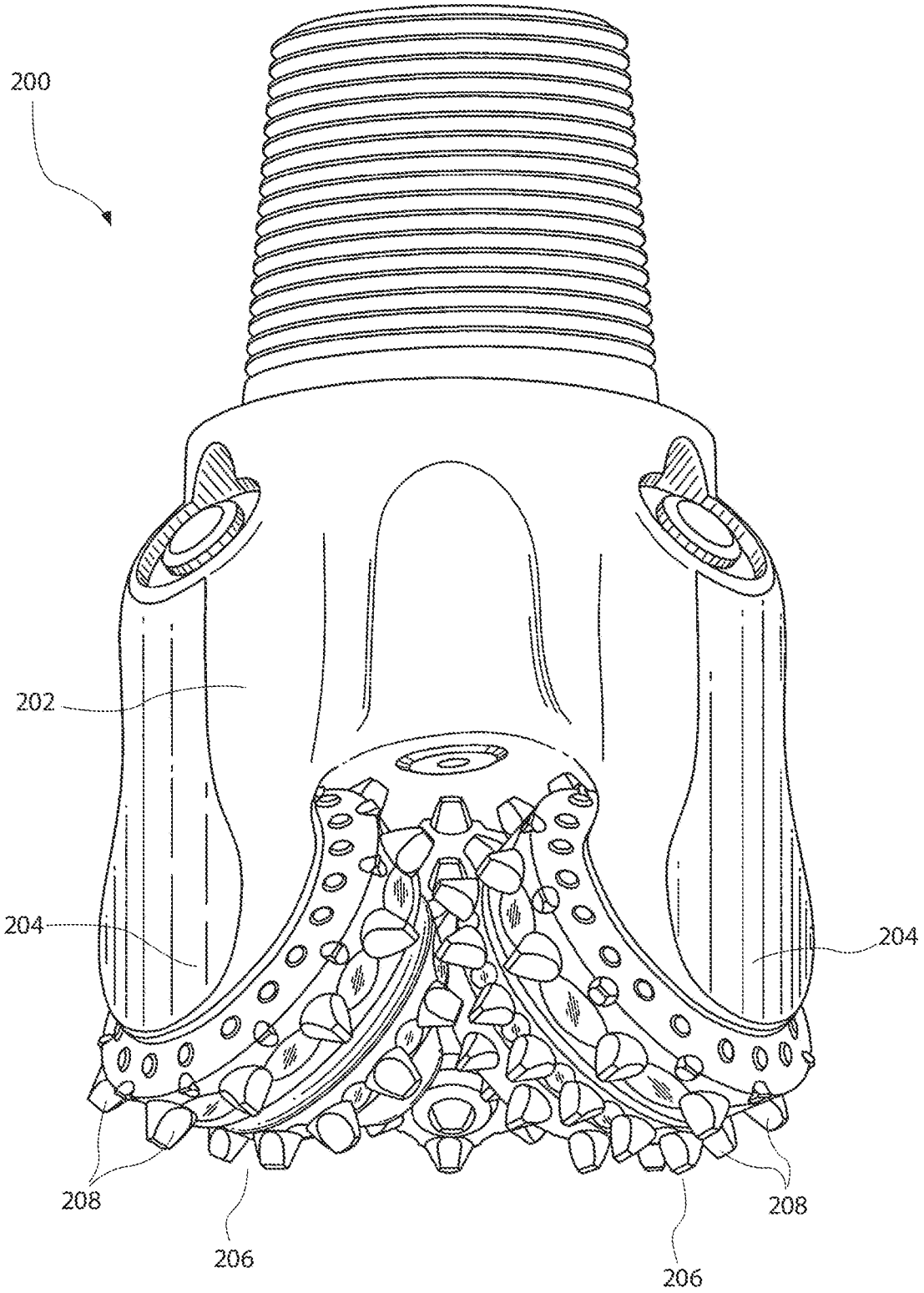
FIG. 2 is a simplified diagram illustrating a drill bit according to one embodiment of the disclosure.

The pilot bit 150 may be, for example, a rolling cutter bit 200, as illustrated in FIG. 2. The rolling cutter bit 200 may include a tool body 202 having integral leg members 204 and rolling cones 206 mounted on heads protruding from the distal ends of corresponding leg members 204. As the rolling cutter bit 200 is rotated within a wellbore, the rolling cones 206 rotate on their corresponding heads. As the rolling cones 206 rotate, cutting structures 208 disposed on the rolling cones 206 may gouge, crush, and scrape away formation material so as to drill the borehole in the subterranean formation. The cutting structures 208 illustrated in FIG. 2 may include inserts (e.g., cemented tungsten carbide and/or polycrystalline diamond inserts), although in other embodiments, the cutting structures 208 may have integral teeth formed on the rolling cones 206 using machining processes. Hardfacing material may, optionally, be applied on surfaces of the rolling cones 206 and to the teeth.

Figure 3:
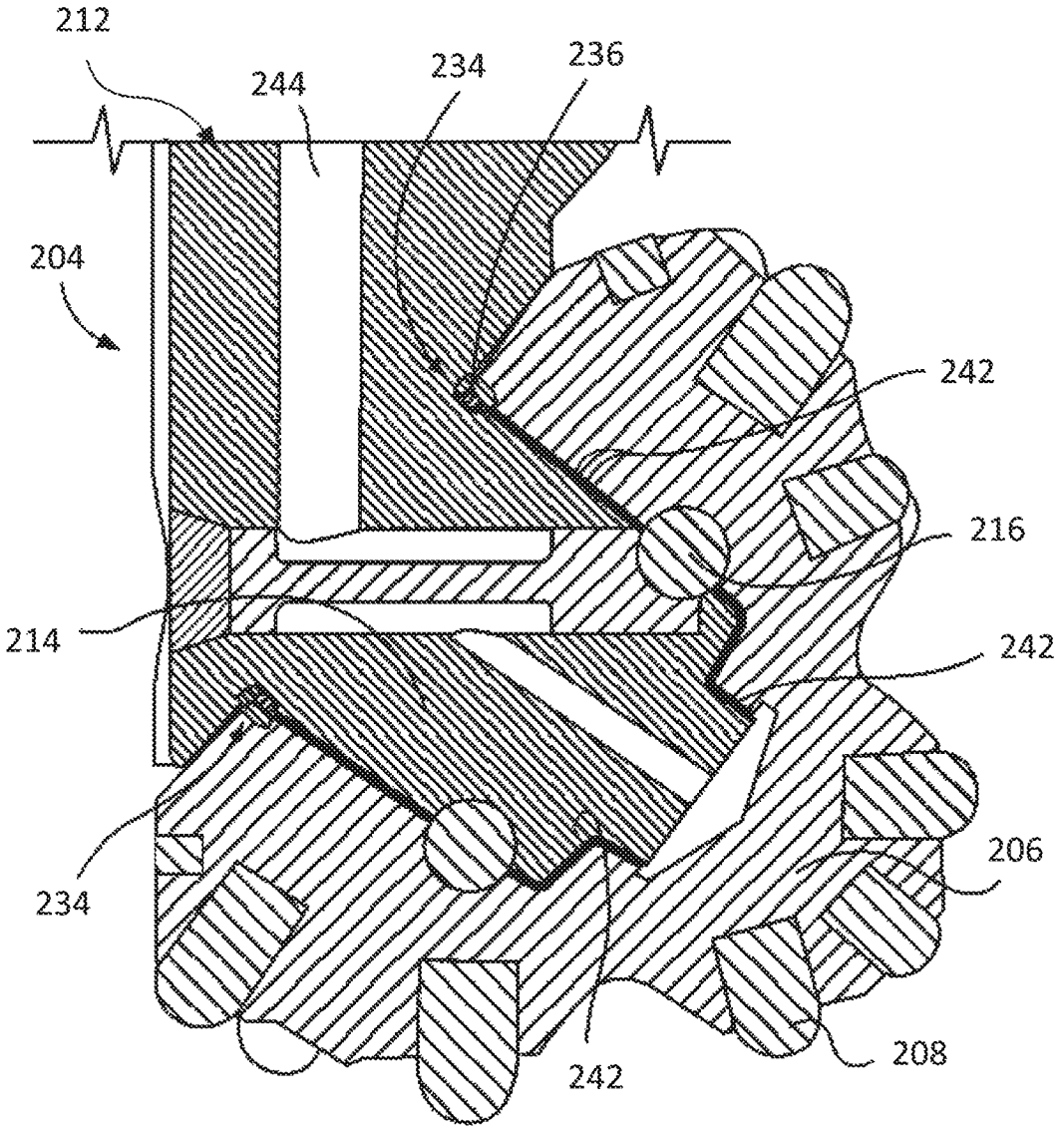
FIG. 3 is a cross-sectional view of a portion of the drill bit shown in FIG. 2.

FIG. 3 is a cross-sectional view of a portion of the rolling cutter bit 200. Each rolling cone 206 (only one of which is shown in FIG. 3) may be rotatably mounted to a bearing pin 214 on a bit leg 212. One or more bearings 216 may be disposed at an interface between the rolling cone 206 and the bearing pin 214.

The bearings 216 may include, for example, one or more radial bearings and/or one or more axial bearings. The bearings 216 may include ball bearings and a ball plug or retainer. The rolling cutter bit 200 may also include a seal assembly 234 between the rolling cone 206 and the bearing pin 214. The seal assembly 234 may include one or more of an elastomer seal, an elastomer seal component, and a metal face seal (MFS) 236. The seal assembly 234 may seal lubricant and other fluids within a channel formed in the rolling cone 206 or between the rolling cone 206 and the bearing pin 214.

In some embodiments, the rolling cutter bit 200 may be assembled with uncoated parts (i.e., parts that do not have any protective coating thereon). For example, the rolling cone 206 and the bearing pin 214 may be machined or otherwise formed (e.g., from a billet of metal), and may then be assembled together uncoated. As used herein, the term "uncoated" means free of a layer of solid material formed over and bonded to a surface. The presence of grease, oils, etc. does not render a surface "coated," under this definition, if the grease or oil could be removed by wiping or with a solvent.

During use of the rolling cutter bit 200, protective coatings 242 may form on surfaces of the rolling cone 206 and the bearing pin 214. In some embodiments, protective coatings may also form on the surfaces of the bearings 216. By forming protective coatings 242 in-situ, the surfaces of the rolling cutter bit 200 may be more evenly coated, and may be continually refreshed. Thus, a rolling cutter bit 200 using such coatings may be relatively more durable and operate with less internal friction than conventional rolling cutter bits.

To form and/or add to the protective coatings 242, the rolling cutter bit 200 may be coupled to a drill string 118 (FIG. 1), and may be operated with a lubricant formulated to form the protective coatings 242. For example, the lubricant may be provided to the surfaces of the rolling cone 206, the bearing pin 214, and/or the bearings 216 by one or more internal passages 244 within the rolling cutter bit 200. The internal passages 244 may be connected to a fluid reservoir, pump, or other features within the drill string 118 configured to deliver the lubricant. The lubricant may be injected into the rolling cutter bit 200 via a port (not shown) that communicates with the internal passage 244.

The lubricant may be a grease, having a semisolid consistency formulated to flow under pressure, but that tends to remain in place when pressure is released. In some embodiments, the lubricant may be a high-temperature lubricant as disclosed in U.S. Pat. No. 7,267,183, "Drill Bit Lubricant with Enhanced Load Carrying/Anti Wear Properties," granted Sep. 11, 2007; U.S. Pat. No. 4,381,824, "Drill Bit Lubrication System," granted May 3, 1983; U.S. Patent Publication 2009/0229886, "Non-Grease Type Bearing Lubricant," published Sep. 17, 2009; or U.S. Pat. No. 7,312,185, "Rock Bit Grease Composition," granted Dec. 25, 2007; the entire disclosure of each of which is incorporated herein by this reference. The lubricant may include a base stock of a polyalphaolefin, and may also include various other additives. The lubricant may have a viscosity of greater than about 100,000 centipoise at a temperature of about 20° C. and a sheer rate of less than about 40 $s^{-1}$. The lubricant may further include an organometallic compound formulated to at least partially decompose when subjected to temperatures at which the rolling cutter bit 200 operates. For example, at a sustained temperature from about 250° C. to about 1000° C., from about 500° C. to about 850° C., from about 550° C. to about 800° C., or even from about 600° C. to about 750° C., the organic portion of organometallic compound may begin to decompose, leaving the metallic portion as metal on surfaces adjacent the lubricant. The metal may form the protective coatings 242. The organometallic compound may be stable at temperatures from about 20° C. to about 500° C., from about 0° C. to about 600° C., or from about −40° C. to about 700° C., for example, such that the organometallic compound may be delivered to the rolling cutter bit 200 through components at lower temperatures without experiencing significant decomposition. The protective coatings 242 may therefore form over surfaces of the rolling cutter bit 200 exposed to the lubricant at high temperatures, which may be the portions of the rolling cutter bit 200 most in need of the protective coatings 242. In other words, the lubricant may be exposed to temperatures greater than about 500° C., greater than about 600° C., or greater than about 700° C., to form the protective coating 242.

An advantage of forming the protective coatings 242 in this manner is that the protective coatings 242 may be continually repaired or enhanced during drilling operations, by continuing to provide the lubricant to the rolling cutter bit 200. The concentration of the organometallic compound may be controlled to control the rate of formation of the protective coatings 242. For example, near the beginning of a drilling operation, the lubricant may include a first concentration of the organometallic compound. Later in the drilling operation, the lubricant may include a second, smaller concentration of the organometallic compound. Thus, the protective coatings 242 may initially be formed quickly by the higher concentration of the organometallic compound, and may later be formed more slowly to maintain the thickness and integrity of the protective coatings 242 throughout the drilling operation.

In some embodiments, the organometallic compound may include a silver-organic molecule, such as the trimeric silver pyrazolate complex, $[Ag(3,5\text{-dimethyl-4-n-hexyl-pyrazolate})]_3$, as described in Michael Desanker et al. "Oil-Soluble Silver-Organic Molecule for in Situ Deposition of Lubricious Metallic Silver at High Temperatures," ACS Appl. Mater. Interfaces, 2016, 8 (21), pp. 13637-13645, the entire disclosure of which is incorporated herein by this reference. For example, the silver-organic molecule may include one or more silver atoms bound with organic complexes, such as cyclic hydrocarbons containing the elements N, P, B, and/or S, along with C and H, and optionally O. Other elements may also be present. The organic complexes may include various functional groups, such as phenol groups, alkyl groups, pryazole groups, etc. If the organometallic compound is a silver-organometallic compound, the protective coatings 242 formed may be substantially metallic silver.

In some embodiments, the lubricant may include one or more additional compounds to enable deposition of the protective coatings 242 or to increase the rate of deposition of the protective coatings 242. For example, an activator may be added to the lubricant that includes a catalyst formulated to react with the organometallic compound.

In some embodiments, the lubricant and/or the surfaces may include catalytic nanoparticles that promote the cracking of hydrocarbon molecules. Breaking C—C bonds may lead to deposition of diamond or diamond-like carbon on the surfaces. For example, surfaces may be configured to have crystalline nanometer-scale features, which may act as a catalyst when exposed to the lubricant. Nanocomposites and cracking of hydrocarbon molecules are described in U.S. Patent Application Publication 2016/0145531, "Method to Produce Catalytically Active Nanocomposite Coatings," published May 26, 2016, the entire disclosure of which is incorporated herein by this reference.

If one or more of the protective coatings 242 become damaged during use, the lubricant may repair the damaged protective coatings 242 by depositing additional metal from the organometallic compound. For example, if the rolling cutter bit 200 is expected to be subjected to particularly harsh conditions, the concentration of the organometallic compound in the lubricant may be increased beyond the amount typically included in the lubricant. Furthermore, the concentration of the organometallic compound may be varied during use. For example, a drilling operation may use a first concentration of the organometallic compound in the lubricant for a period of time sufficient to cause an increased rate of deposition of the protective coatings 242, followed by a second, lower concentration of the organometallic compound in the lubricant to cause a lower rate of deposition of the protective coatings 242. The protective coatings 242, when exposed to the lubricant, may be self-healing.

Furthermore, by forming the protective coatings 242 in situ (within a wellbore or otherwise), the costs of producing the rolling cutter bit 200 may be decreased. The protective coatings 242 may form more uniformly and without extra processing steps, as compared to conventional methods of forming protective coatings. The protective coatings 242 may be formed without causing interference because the parts of the rolling cutter bit 200 are already placed together in mutual contact before the protective coatings 242 are formed. Tools having such protective coatings 242 may experience significant reductions in wear and friction.

While the present disclosure has been described herein with respect to a rolling cutter bit 200 (FIG. 2), embodiments of the disclosure have utility with different and various types and configurations of wellbore tools, such as motors and pumps (e.g., having rotors that rotate within stators), hybrid bits, and any other tools having parts that move with respect to one another. In addition, seals and sealing surfaces may be coated using the methods described.

Additional non limiting example embodiments of the disclosure are described below.

Embodiment 1

A method of utilizing a wellbore tool in a subterranean formation, the method comprising disposing a wellbore tool in a borehole. The wellbore tool comprises a first body and a second body. The method further comprises translating the first body relative to the second body while exposing at least one surface of at least one of the first and second bodies to a lubricant comprising an organometallic compound, and forming a protective coating over a surface of at least one body selected from the group consisting of the first body and the second body. The protective coating comprises a metal originating from the organometallic compound.

Embodiment 2

The method of Embodiment 1, wherein the organometallic compound comprises a silver-organic molecule.

Embodiment 3

The method of Embodiment 1 or Embodiment 2, wherein the protective coating comprises silver.

Embodiment 4

The method of any of Embodiments 1 through 3, wherein the lubricant comprises a solid.

Embodiment 5

The method of any of Embodiments 1 through 4, wherein the lubricant comprises grease.

Embodiment 6

The method of any of Embodiments 1 through 5, wherein forming a protective coating comprises exposing the lubricant to a sustained temperature of greater than about 500° C.

Embodiment 7

The method of Embodiment 6, wherein forming a protective coating comprises exposing the lubricant to a sustained temperature of greater than about 700° C.

Embodiment 8

The method of any of Embodiments 1 through 7, wherein the organometallic compound is stable at temperatures from about 20° C. to about 500° C.

Embodiment 9

The method of any of Embodiments 1 through 8, wherein the organometallic compound is formulated to decompose and release the metal at a temperature from about 500° C. to about 850° C.

Embodiment 10

The method of any of Embodiments 1 through 9, wherein at least one of the first body and the second body is uncoated when the wellbore tool is first disposed in the borehole.

Embodiment 11

The method of any of Embodiments 1 through 10, wherein the first body comprises a bearing pin, and wherein the second body comprises a roller cone.

Embodiment 12

The method of any of Embodiments 1 through 11, wherein the wellbore tool further comprises at least one additional body between the first body and the second body.

Embodiment 13

The method of any of Embodiments 1 through 12, further comprising repairing at least a portion of the protective coating by depositing the metal of the organometallic compound over the at least one body while the wellbore tool is disposed in the wellbore.

Embodiment 14

A method of coating a surface of a tool, the method comprising disposing a tool in a borehole, the tool comprising at least one uncoated surface; contacting the at least one uncoated surface with a lubricant adjacent a body; and forming a protective coating on the at least one uncoated surface. The lubricant comprises an organometallic compound. The protective coating comprise a metal originating from the organometallic compound.

Embodiment 15

The method of Embodiment 14, wherein contacting the at least one uncoated surface with a lubricant adjacent a body comprises passing the lubricant adjacent the at least one uncoated surface.

Embodiment 16

The method of Embodiment 14 or Embodiment 15, wherein forming a protective coating on the at least one uncoated surface comprises heating the lubricant and forming the metal from at least a portion of the organometallic compound.

Embodiment 17

The method of any of Embodiments 14 through 16, wherein forming a protective coating on the at least one uncoated surface comprises forming a silver coating on the at least one uncoated surface.

Embodiment 18

A tool for forming or servicing a wellbore, comprising a first body; a second body configured to translate relative to the second body; and a lubricant adjacent the first body and the second body. The lubricant comprises an organometallic compound.

Embodiment 19

The tool of Embodiment 18, wherein the second body comprises a bearing.

Embodiment 20

The tool of Embodiment 18 or Embodiment 19, wherein at least one of the first body and the second body comprises an uncoated metal.

While the present disclosure has been described herein with respect to a rolling cutter bit, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventor. Further, embodiments of the disclosure have utility with different and various types and configurations of wellbore tools, including any tools having parts that move with respect to one another.

What is claimed is:

1. A method of utilizing a wellbore tool in a subterranean formation, the method comprising:

disposing a wellbore tool in a borehole, the wellbore tool comprising a first body and a second body;

translating the first body relative to the second body while exposing at least one surface of at least one of the first and second bodies to a lubricant comprising an organometallic compound, the exposing comprising:

injecting, into an internal passage of the wellbore tool, the lubricant comprising the organometallic compound at a first concentration to provide the lubricant of the first concentration to the at least one surface; and thereafter, injecting, into the internal passage of the wellbore tool, the lubricant comprising the organometallic compound at a second concentration different than the first concentration to provide the lubricant of the second concentration to the at least one surface; and forming a protective coating over a surface of at least one body selected from the group consisting of the first body and the second body after the wellbore tool is disposed in the borehole, the protective coating comprising a metal originating from the organometallic compound.

2. The method of claim 1, wherein the organometallic compound comprises a silver-organic molecule.

3. The method of claim 1, wherein the protective coating comprises silver.

4. The method of claim 1, wherein the lubricant comprises a solid.

5. The method of claim 1, wherein the lubricant comprises grease.

6. The method of claim 1, wherein at least one of the first body and the second body is uncoated when the wellbore tool is first disposed in the borehole.

7. The method of claim 1, wherein the first body comprises a bearing pin, and wherein the second body comprises a roller cone.

8. The method of claim 1, wherein the wellbore tool further comprises at least one additional body between the first body and the second body.

9. The method of claim 1, further comprising repairing at least a portion of the protective coating by depositing the metal of the organometallic compound over the at least one body while the wellbore tool is disposed in the wellbore.

10. The method of claim 1, wherein the second concentration is lower than the first concentration.

11. A method of coating a surface of a tool, the method comprising:

disposing a tool in a borehole, the tool comprising at least one uncoated surface; and contacting the at least one uncoated surface with a lubricant adjacent to a body to form a protective coating on the at least one uncoated surface after the tool is disposed in the borehole, the lubricant comprising an organometallic compound, the contacting comprising injecting the lubricant into an internal passage of the tool at a first concentration of the organometallic compound and, afterward, injecting the lubricant into the internal passage of the tool at a second concentration of the organometallic compound, the second concentration differing from the first concentration;

wherein the protective coating comprises a metal originating from the organometallic compound.

12. The method of claim 11, wherein contacting the at least one uncoated surface with a lubricant adjacent to a body further comprises passing the lubricant adjacent the at least one uncoated surface.

13. The method of claim 11, wherein further comprising heating the lubricant and forming the metal from at least a portion of the organometallic compound.

14. The method of claim 11, wherein contacting the at least one uncoated surface with a lubricant adjacent to a body to form a protective coating on the at least one uncoated surface comprises forming a silver coating on the at least one uncoated surface.

15. The method of claim 11, further comprising, during the contacting:

forming the protective coating at a first rate while the lubricant at the first concentration of the organometallic compound; and forming the protective coating at a second rate while the lubricant is at the second concentration of the organometallic compound, the first concentration being higher than the second concentration, and the first rate being faster than the second rate.

* * * * *